US005160373A

United States Patent [19]

Senda et al.

[11] Patent Number: 5,160,373

[45] Date of Patent: Nov. 3, 1992

[54] ELECTROLESS PLATING BATH

[75] Inventors: Atsuo Senda, Otsu; Takuji Nakagawa, Kyoto; Yoshihiko Takano, Nagaokakyo, all of Japan

[73] Assignee: Murata Manufacturing Co., Ltd., Japan

[21] Appl. No.: 713,782

[22] Filed: Jun. 12, 1991

[30] Foreign Application Priority Data

Apr. 26, 1991 [JP] Japan ..... 3-96919

[51] Int. Cl.[5] ..... C23C 18/34

[52] U.S. Cl. ..... 106/1.29; 106/1.27

[58] Field of Search ..... 106/1.11, 1.25, 1.27, 106/1.29

[56] References Cited

FOREIGN PATENT DOCUMENTS 62-284083 12/1987 Japan .

*Primary Examiner*—William R. Dixon, Jr.
*Assistant Examiner*—Margaret V. Einsmann
*Attorney, Agent, or Firm*—Ostrolenk, Faber, Gerb & Soffen

[57] ABSTRACT

An electroless plating bath for depositing a metal selected from the group consisting of Ni, Zn, As, Cd, In, Sb, Pb and alloys thereof, which contains a titanium (III) compound as a reducing agent. Typical titanium (III) compounds are titanium halides, cyclopentadienyl complex compounds of titanium (III) ions, titanium sulfate, and titanium hydroxide.

5 Claims, No Drawings

ELECTROLESS PLATING BATH

FIELD OF THE INVENTION

The present invention relates to an electroless plating bath.

BACKGROUND OF THE INVENTION

Chemical reduction plating, so called electroless plating, is a process for depositing metallic coatings on solid surfaces by reducing metal ions present in an electroless plating bath with a chemical reducing agent dissolved therein. Major advantages of electroless plating is its ability to give metal coatings on surfaces of nonconductors such as ceramics, resins and the like without application of electric currents, and the ability to give uniform metallic coatings even on articles having complex geometric shapes of the surfaces to be plated. In addition, the electroless plating is superior in mass producibility to vacuum film deposition techniques such as sputtering and vacuum deposition since it is continuously operated with a cheap devices.

Electroless plating baths generally contain a metal salt, a complexing agent, a chemical reducing agent and a pH adjuster. In the electroless plating baths of the prior art, the reducing agents widely used are formaldehyde, hydrazine, hypophosphitc, hydrogenated boron compounds, etc.

Such reducing agents make it possible to deposit some metals such as Co, Ni, Cu, Pd, Ag, Pt and Au in the form of a pure metal or a metal-phosphorous or metal-boron alloy. For example, an electroless nickel plating bath containing hypophosphite as the reducing agent gives coatings of a Ni-P alloy, while an electroless plating bath containing a hydrogenated boron compound gives coatings of a Ni-B alloy.

However, the electroless plating baths of the prior art cannot be applied to deposit metal coatings on ceramics for electronic devices since the reducing agent such as formaldehyde, hydrazine, hypophosphite, or a hydrogenated boron compound produces activated hydrogen during electroless plating to reduce some metal oxides constituting the ceramics. In addition, it is required to incorporate such a reducing agent into the electroless plating bath in an amount approximately equal to the molar concentrations of the metal to be plated.

It is also impossible with the electroless baths of the prior art to deposit sole coatings of some metals of V, Mn, Fe, Zn, Mo, W, Re and Tl though such a metal can be deposited along with deposition of Co, Ni or Cu. In other words, these metals can be deposited only in the form of a eutectic composition with Co, Ni or Cu. For example, zinc can be deposited in the form of a Ni-Zn-P alloy, but cannot be deposited solely.

Further, it is impossible with any reducing agents of the prior art to deposit coatings of As, Cd, In, Sb or Pb by electroless plating because these metals serve as a catalyst poison.

The first report on electroless plating of Sn, which has been considered to be one of metals incapable of being deposited by electroless plating, was presented by K. Obata, T. Sonoda and N. Dohi in "Electroless deposition of Tin using $Ti^{+3}$ as reducing agent" Metal Surface techniques, vol. 33, No. 8, P 17-21, 1982. This report teaches that electroless tin plating can be achieved by use of a bath containing $TiCl_3$ as a reducing agent.

Up to now, however, there is no report on electroless plating of metals such as As, Cd, In, Sb and Pb, each of which serves as a catalyst poison.

SUMMARY OF THE INVENTION

It is therefore a major object of the present invention to provide an electroless plating bath which makes it possible to deposit coatings of metals such as As, Cd, In Sb, Pb, or Zn at the least by electroless plating.

Another object of the present invention is to provide an electroless plating bath which makes it possible to deposit not only coatings of metals incapable of being deposited with the electroless bath of the prior art, but also coatings of metals capable of being deposited with the electroless bath of the prior art.

These and other objects of the present invention are achieved by use of an electroless plating bath containing one of titanium (III) compounds or salts as a reducing agent.

DETAILED DESCRIPTION OF THE INVENTION

According to the present invention there is provided an electroless plating bath for depositing a metal selected from the group consisting of Ni, Zn, As, Cd, In, Sb, Pb and alloys thereof, characterized in that said bath contains a titanium (III) compound as a reducing agent.

Typical titanium (III) compound to be used as a reducing agent includes, without being limited to, titanium halides such as $TiCl_3$, and $TiI_3$; cyclopentadienyl complex compounds such as $Ti(C_5H_5)_3$, $Ti(C_5H_5)_2Cl$; titanium sulfate ($Ti_2(SO_4)_3$); and titanium hydroxide ($Ti(OH)_3$).

In use, the electroless plating bath of the present invention is controlled to a temperature ranging from 20° to 90 ° C. and its pH is adjusted to a value ranging from 2 to 10.5.

During electroless plating, a titanium (III) salt or compound used as the reducing agent dissociates into titanium (III) ions in solution, and these titanium (III) ions, $Ti^{+3}$, are oxidized under the following equation to release electrons. $Ti^{+3}+2OH^- \rightarrow TiO^{2+}+H_2O+e^-$ The released electrons reduce metal ions present in the solution and make it possible to deposit coatings of metals such as As, Pd, Ag, Cd, and In or alloys mainly containing such a metal, on solid catalytic surfaces to be plated.

The electroless plating bath of the present invention can be applied to deposit metal coatings on both nonconductors such as glass, resins, ceramics; and conductors such as copper, iron, nickel, etc.

In case of that the article to be plated is of a nonconductor, the surface of the article is activated, before electroless plating, with a stannous chloride solution or a palladium chloride solution as well as that of the conventional process of electroless plating. Such a preliminary treatment may be replaced with activation by vacuum techniques employing palladium or silver.

If the article to be plated is of a conductor, such pre-treatment may be accomplished before electroless plating. However, electroless plating may be accomplished just after rinsing the surfaces with acids, without application of the pre-treatment.

As will be understood from the above equation, no hydrogen is produced during electroless plating, so that the electroless plating bath of the present invention prevent ceramics from reduction of metal oxides which is inherent to the electroless plating baths of the prior art containing formaldehyde, hydrazine, hypophosphite, or a hydrogenated boron compound as the reducing agent. Thus, there is no fear of deterioration of electrical properties even when the electroless plating bath of the present invention is applied for depositing metal coatings on electronic ceramics such as dielectric ceramics, oxide magnetic materials or ferrites, and semiconductor ceramics.

The electroless plating bath of the present invention makes it possible to deposit metals, which have been regarded as a material incapable of being plated by electroless plating, such as As, Cd, In, Sb, Pb or an alloy mainly containing such a metal. Also, the electroless plating bath of the present invention makes it possible to deposit nickel on solid surfaces, although nickel can be plated by the baths of the prior art.

Also, it is possible with the electroless plating bath of the present invention to deposit metal coatings substantially containing decomposition products, such as phosphor or boron, of the reducing agent. In addition, according to the present invention, electroless plating can be accomplished effectively even when the reducing agent is contained in an amount equal to or less than the molar amount of the metal to be plated.

These and other objects, features and advantages of the present invention will be understood in detail from the following description with reference to the preferred examples thereof.

EXAMPLE 1

This example is given to explain electroless antimony plating on nonconductors.

Using $SbCl_3$ as a metal source, ethylenediamine tetraacetic acid (EDTA) as a complexing agent for Sb ions, $TiCl_3$ as a reducing agent, and nitrilo triacetic acid (NTA) as a complexing agent for Ti ions, there was prepared an electroless antimony plating bath containing these ingredients in the proportions shown in Table 1.

TABLE 1

| Compound | Concentration (mol/l) |
|---|---|
| $SbCl_3$ | 0.08 |
| EDTA | 0.08 |
| citric acid | 0.34 |
| $TiCl_3$ | 0.04 |
| NTA | 0.20 |

Using the resultant bath, electroless plating was applied on an alumina plate by immersing it in the bath for 30 minutes. During electroless plating, the bath was controlled to a temperature of 10° to 30 ° C. and pH of the bath was adjusted to a value ranging from 6 to 9 by addition of aqueous ammonia. An antimony coating 3 μm in thickness was deposited on the alumina plate.

EXAMPLE 2

This example is given to explain electroless arsenic plating.

Using $NaAsO_2$ as a metal source; ethylenediamine tetraacetic acid (EDTA) and citric acid as complexing agents for $NaAsO_2$; $TiCl_3$ as a reducing agent; and nitrilo triacetic acid (NTA) as a complexing agent for Ti, there was prepared an electroless plating bath containing these compounds in the proportions shown in Table 2.

TABLE 2

| Compound | Concentration (mol/l) |
|---|---|
| $NaAsO_3$ | 0.08 |
| EDTA | 0.08 |
| Citric acid | 0.34 |
| $TiCl_3$ | 0.04 |
| NTA | 0.20 |

Using the resultant electroless plating bath, electroless plating was applied on an alumina plate by immersing it in the bath for 30 minutes. During electroless plating, the bath was controlled to a temperature of 70° to 90 ° C. and pH of the bath was adjusted to 6 to 10 by addition of aqueous ammonia. An arsenic coating 0.5 μm in thickness was deposited on the alumina plate.

EXAMPLE 3

Using $CdCl_2.3/2H_2O$, EDTA, citric acid, $TiCl_3$ and NTA as ingredients, there was prepared an electroless plating bath containing these compounds in the proportions shown in Table 3.

TABLE 3

| Compound | Concentration (mol/l) |
|---|---|
| $CdCl_2.3/2H_2O$ | 0.08 |
| EDTA | 0.08 |
| Citric acid | 0.34 |
| $TiCl_3$ | 0.04 |
| NTA | 0.20 |

The resultant electroless plating bath was controlled to a temperature of 70° to 90 ° C. and pH of the bath was adjusted to a value ranging from 9 to 10 by addition of aqueous ammonia. Under such conditions, electroless plating was applied on an alumina plate by immersing it in the bath for 30 minutes. A cadmium coating 1 μm in thickness was deposited on the alumina plate.

EXAMPLE 4

Using $InCl_3.4H_2O$, citric acid, $TiCl_3$ and NTA as ingredients, there was prepared an electroless plating bath containing these compounds in the proportions shown in Table 4.

TABLE 4

| Compound | Concentration (mol/l) |
|---|---|
| $InCl_3.4H_2O$ | 0.08 |
| Citric acid | 0.34 |
| $TiCl_3$ | 0.04 |
| NTA | 0.20 |

The resultant electroless plating bath was controlled to a temperature of 70° to 90 ° C. and pH of the bath was adjusted to a value ranging from 9 to 10 by addition of aqueous ammonia. Under such conditions, electroless plating was applied on an alumina plate by immersing it in the bath for 30 minutes. An indium coating 1 μm in thickness was deposited on the alumina plate.

EXAMPLE 5

Using $PbCl_2$, EDTA, citric acid, $TiCl_3$ and NTA as ingredients, there was prepared an electroless plating bath containing these compounds in the proportions shown in Table 5.

TABLE 5

| Compound | Concentration (mol/l) |
|---|---|
| $PbCl_2$ | 0.08 |

TABLE 5-continued

| Compound | Concentration (mol/l) |
|---|---|
| EDTA | 0.08 |
| Citric acid | 0.34 |
| $TiCl_3$ | 0.04 |
| NTA | 0.20 |

The resultant electroless plating bath was controlled to a temperature of 20° to 30 ° C. and pH of the bath was adjusted to a value ranging from 7 to 10 by addition of aqueous ammonia. Under such conditions, electroless plating was applied on an alumina plate by immersing it in the bath for 60 minutes. A lusterless lead coating 2 μm in thickness was deposited on the alumina plate.

EXAMPLE 6

Using $ZnCl_2$, EDTA, citric acid, $TiCl_3$ and NTA as ingredients, there was prepared an electroless plating bath containing these compounds in the proportions shown in Table 6.

TABLE 6

| Compound | Concentration (mol/l) |
|---|---|
| $ZnCl_2$ | 0.08 |
| EDTA | 0.08 |
| Citric acid | 0.34 |
| $TiCl_3$ | 0.04 |
| NTA | 0.20 |

The resultant electroless plating bath was controlled to a temperature of 80° to 90 ° C. and pH of the bath was adjusted to a value ranging from 9 to 10 by addition of aqueous ammonia. Under such conditions, electroless plating was applied on an alumina plate by immersing it in the bath for 60 minutes. Zinc coating 0.4 μm in thickness was deposited on the alumina plate.

EXAMPLE 7

Using $NiCl_2.6H_2O$, sodium tartrate, $TiCl_3$ and NTA as ingredients, there was prepared an electroless nickel plating bath containing these compounds in the proportions shown in Table 7. Sodium tartrate was used as a complexing agent for nickel.

TABLE 7

| Compound | Concentration (mol/l) |
|---|---|
| $NiCl_2.6H_2O$ | 0.08 |
| Sodium tartrate | 0.16 |
| $TiCl_3$ | 0.04 |
| NTA | 0.20 |

The resultant electroless plating bath was controlled to a temperature of 70° to 90 ° C. and pH of the bath was adjusted to a value ranging from 8 to 10 by addition of aqueous ammonia. Under such conditions, electroless plating was applied on an alumina plate by immersing it in the bath for 30 minutes. Semibright nickel coating 0.5 μm in thickness was deposited on the alumina plate.

EXAMPLE 8

Using $InCl_2.4H_2O$, $SbCl_3$, EDTA, citric acid, $TiCl_3$ and NTA as ingredients, there was prepared an electroless plating bath containing these compounds in the proportions shown in Table 8.

TABLE 8

| Compound | Concentration (mol/l) |
|---|---|
| $InCl_2.4H_2O$ | 0.06 |

TABLE 8-continued

| Compound | Concentration (mol/l) |
|---|---|
| $SbCl_3$ | 0.02 |
| EDTA | 0.08 |
| Citric acid | 0.34 |
| $TiCl_3$ | 0.04 |
| NTA | 0.20 |

The resultant electroless plating bath was controlled to a temperature of 40° to 50 ° C. and pH of the bath was adjusted to a value ranging from 7 to 9 by addition of aqueous ammonia. While keeping such conditions, electroless plating was applied on an alumina plate by immersing it in the bath for 30 minutes. In-Sb alloy coating 2 μm in thickness was deposited on the alumina plate.

EXAMPLE 9

Using $NaAsO_2$, $GaCl_3$, EDTA, citric acid, $TiCl_3$ and NTA as ingredients, there was prepared an electroless plating bath containing these compounds in the proportions shown in Table 9.

TABLE 9

| Compound | Concentration (mol/l) |
|---|---|
| $NaAsO_2$ | 0.04 |
| $GaCl_3$ | 0.04 |
| EDTA | 0.08 |
| Citric acid | 0.34 |
| $TiCl_3$ | 0.04 |
| NTA | 0.20 |

The resultant electroless plating bath was controlled to a temperature of 70° to 90 ° C. and pH of the bath was adjusted to a value ranging from 9 to 10 by addition of aqueous ammonia. While keeping such conditions, electroless plating was applied on an alumina plate by immersing it in the bath for 60 minutes. A Ga-As alloy coating 1 μm in thickness was deposited on the alumina plate.

EXAMPLE 10

Using $SbI_3$, EDTA, citric acid, $TiI_3$ and NTA as ngredients, there was prepared an electroless plating bath containing these compounds in the proportions shown in Table 10.

TABLE 10

| Compound | Concentration (mol/l) |
|---|---|
| $SbI_3$ | 0.08 |
| EDTA | 0.08 |
| Citric acid | 0.34 |
| $TiI_3$ | 0.04 |
| NTA | 0.20 |

The resultant electroless plating bath was controlled to a temperature of 10° to 30 ° C. and pH of the bath was adjusted to a value ranging from 6 to 9 by addition of aqueous ammonia. While keeping such conditions, electroless plating was applied on an alumina plate by immersing it in the bath for 30 minutes. Antimony coating 3 μm in thickness was deposited on the alumina plate.

EXAMPLE 11

Using $NaAsO_2$, EDTA, citric acid, $Ti(C_5H_5)_3$ and NTA as ingredients, there was prepared an electroless plating bath containing these compounds in the proportions shown in Table 11.

TABLE 11

| Compound | Concentration (mol/l) |
|---|---|
| $NaAsO_2$ | 0.08 |
| EDTA | 0.08 |
| Citric acid | 0.34 |
| $Ti(C_5H_5)_3$ | 0.04 |
| NTA | 0.20 |

The resultant electroless plating bath was controlled to a temperature of 70° to 90 ° C. and pH of the bath was adjusted to a value ranging from 6 to 10 by addition of aqueous ammonia. Under such conditions, electroless plating was applied on an alumina plate by immersing it in the bath for 30 minutes. An arsenic coating 0.5 μm in thickness was deposited on the alumina plate.

EXAMPLE 12

Using $CdCl_2.2.5H_2O$, EDTA, citric acid, $TiCl(C_5H_5)_2$ and NTA as ingredients, there was prepared an electroless plating bath containing these compounds in the proportions shown in Table 12.

TABLE 12

| Compound | Concentration (mol/l) |
|---|---|
| $CdCl_2 2.5H_2O$ | 0.08 |
| EDTA | 0.08 |
| Citric acid | 0.34 |
| $TiCl(C_5H_5)_2$ | 0.04 |
| NTA | 0.20 |

The resultant electroless plating bath was heated and maintained at a temperature of 70° to 90 ° C. and pH of the bath was adjusted to a value ranging from 9 to 10.5 by addition of aqueous ammonia. While keeping such conditions, electroless plating was applied on an alumina plate by immersing it in the bath for 30 minutes. A cadmium coating 1 μm in thickness was deposited on the alumina plate.

EXAMPLE 13

Using $In_2(SO_4)_3.9H_2O$, citric acid, $Ti_2(SO_4)_3$ and NTA as ingredients, there was prepared an electroless plating bath containing these compounds in the proportions shown in Table 13.

TABLE 13

| Compound | Concentration (mol/l) |
|---|---|
| $In_2(SO_4)_3.9H_2O$ | 0.08 |
| Citric acid | 0.34 |
| $Ti_2(SO_4)_3$ | 0.04 |
| NTA | 0.20 |

The resultant electroless plating bath was controlled to a temperature of 70° to 90 ° C. and pH of the bath was adjusted to a value ranging from 9 to 10.5 by addition of aqueous ammonia. Under such conditions, electroless plating was applied on an alumina plate by immersing it in the bath for 30 minutes. An indium coating 1 μm in thickness was deposited on the alumina plate.

EXAMPLE 14

Using $PbSO_4$, EDTA, citric acid, $Ti_2(SO_4)_3$ and NTA as ingredients, there was prepared an electroless plating bath containing these compounds in the proportions shown in Table 14.

TABLE 14

| Compound | Concentration (mol/l) |
|---|---|
| $PbSO_4$ | 0.08 |
| EDTA | 0.08 |
| Citric acid | 0.34 |
| $Ti_2(SO_4)_3$ | 0.04 |
| NTA | 0.20 |

The resultant electroless plating bath was controlled to a temperature of 20° to 30 ° C. and pH of the bath was adjusted to a value ranging from 7 to 10 by addition of aqueous ammonia. Under such conditions, electroless plating was applied on an alumina plate by immersing it in the bath for 30 minutes. A lead coating 2 μm in thickness was deposited on the alumina plate.

EXAMPLE 15

Using $ZnSO_4.7H_2O$, EDTA, citric acid, $TiCl(C_5H_5)_2$ and NTA as ingredients, there was prepared an electroless plating bath containing these compounds in the proportions shown in Table 15.

TABLE 15

| Compound | Concentration (mol/l) |
|---|---|
| $ZnSO_4.7H_2O$ | 0.08 |
| EDTA | 0.08 |
| Citric acid | 0.34 |
| $TiCl(C_5H_5)_2$ | 0.04 |
| NTA | 0.20 |

The resultant electroless plating bath was controlled to a temperature of 80° to 90 ° C. and pH of the bath was adjusted to a value ranging from 9 to 10.5 by addition of aqueous ammonia. Under such conditions, electroless plating was applied on an alumina plate by immersing it in the bath for 60 minutes. A zinc coating 0.4 μm in thickness was deposited on the alumina plate.

EXAMPLE 16

Using $NiSO_4.7H_2O$, sodium tartrate, $Ti_2(SO_4)_3$ and NTA as ingredients, there was prepared an electroless plating bath containing these compounds in the proportions shown in Table 16. Sodium tartrate was used as a complexing agent for nickel.

TABLE 16

| Compound | Concentration (mol/l) |
|---|---|
| $NiSO_4.7H_2O$ | 0.08 |
| Sodium tartrate | 0.16 |
| $Ti_2(SO_4)_3$ | 0.04 |
| NTA | 0.20 |

The resultant electroless plating bath was controlled to a temperature of 70° to 90 ° C. and pH of the bath was adjusted to a value ranging from 8 to 10.5 by addition of aqueous ammonia. Under such conditions, electroless plating was applied on an alumina plate by immersing it in the bath for 30 minutes. Semibright nickel coating 0.5 μm in thickness was deposited on the alumina plate.

EXAMPLE 17

Using $In_2(SO_4)_3.9H_2O$, $Sb_2(SO_4)_3$, EDTA, citric acid, $Ti_2(SO_4)_3$ and NTA as ingredients, there was prepared an electroless plating bath containing these compounds in the proportions shown in Table 17. Sodium tartrate was used as a complexing agent for nickel.

TABLE 17

| Compound | Concentration (mol/l) |
|---|---|
| $In_2(SO_4)_3.9H_2O$ | 0.06 |
| $Sb_2(SO_4)_3$ | 0.02 |
| EDTA | 0.08 |
| Citric acid | 0.34 |
| $Ti_2(SO_4)_3$ | 0.04 |
| NTA | 0.20 |

The resultant electroless plating bath was controlled to a temperature of 40° to 50 ° C. and pH of the bath was adjusted to a value ranging from 7 to 9 by addition of aqueous ammonia. While keeping such conditions, electroless plating was applied on an alumina plate by immersing it in the bath for 30 minutes. An In-Sb alloy coating 2 μm in thickness was deposited on the alumina plate.

EXAMPLE 18

Using $NaAsO_2$, $GaCl_3$, EDTA, citric acid, $TiI_3$ and NTA as ingredients, there was prepared an electroless plating bath containing these compounds in the proportions shown in Table 18.

TABLE 18

| Compound | Concentration (mol/l) |
|---|---|
| $NaAsO_2$ | 0.04 |
| $GaCl_3$ | 0.04 |
| EDTA | 0.08 |
| Citric acid | 0.34 |
| $TiI_3$ | 0.04 |
| NTA | 0.20 |

The resultant electroless plating bath was controlled to a temperature of 70° to 90 ° C. and pH of the bath was adjusted to a value ranging from 7 to 10 by addition of aqueous ammonia. Under such conditions, electroless plating was applied on an alumina plate by immersing it in the bath for 60 minutes. A Ga-As coating 1 μm in thickness was deposited on the alumina plate.

EXAMPLE 19

Using $CdSO_4.8/3H_2O$, $Na_2S_2O_3$, EDTA, citric acid, $Ti_2(SO_4)_3$ and NTA as ingredients, there was prepared an electroless plating bath containing these compounds in the proportions shown in Table 19. $Na_2S_2O_3$ was used as a sulfer source.

TABLE 19

| Compound | Concentration (mol/l) |
|---|---|
| $CdSO_4.8/3H_2O$ | 0.08 |
| $Na_2S_2O_3$ | 0.04 |
| EDTA | 0.08 |
| Citric acid | 0.34 |
| $Ti_2(SO_4)_3$ | 0.04 |
| NTA | 0.20 |

The resultant electroless plating bath was controlled to a temperature of 30° to 90 ° C. and pH of the bath was adjusted to a value ranging from 4 to 10.5 by addition of aqueous ammonia. Under such conditions, electroless plating was applied on an alumina plate by immersing it in the bath for 60 minutes. A CdS coating 500 Å in thickness was deposited on the alumina plate.

In the most examples, nitrilo triacetic acid (NTA) is used as a complexing agent for Ti to improve stabilization of the plating bath, but it is not necessarily required to incorporate NTA into the bath.

What is claimed is:

1. An electroless plating bath for depositing a metal selected from the group consisting of Ni, Zn, As, Cd, In, Sb, Pb and alloys thereof, comprising a titanium (III) compound as a reducing agent, a first complexing agent for said depositing metal and a second complexing agent for said titanium (III) compound.

2. An electroless plating bath as claimed in claim 1 wherein said titanium (III) compound is a compound selected from the group consisting of titanium halides, cyclopentadienyl complex compounds of titanium (III) ions, titanium sulfate, and titanium hydroxide.

3. An electroless plating bath as claimed in claim 1 wherein the bath has a temperature ranging from 20° to 90° C. and a pH value ranging from 2 to 10.5.

4. An electroless plating bath as claimed in claim 1, wherein the first complexing agent is selected from the group consisting of ethylenediaminetetraacetic acid, citric acid, sodium tartrate and a mixture of ethylenediaminetetraacetic acid and citric acid.

5. An electroless plating bath as claimed in claim 1, wherein the second complexing agent is nitrilo triacetic acid.

* * * * *